US010957992B2

(12) United States Patent
Randolph et al.

(10) Patent No.: US 10,957,992 B2
(45) Date of Patent: Mar. 23, 2021

(54) SOLDERLESS CONNECTION TO LITZ WIRE

(71) Applicant: TE CONNECTIVITY CORPORATION, Berwyn, PA (US)

(72) Inventors: Kurt Allan Randolph, Etters, PA (US); Jeffrey Richard Ruth, Middletown, PA (US); Paul Walter McDowell, Fishers, IN (US)

(73) Assignee: TE Connectivity Services GmbH, Schaffhausen (CH)

( * ) Notice: Subject to any disclaimer, the term of this patent is extended or adjusted under 35 U.S.C. 154(b) by 0 days.

(21) Appl. No.: 16/449,577

(22) Filed: Jun. 24, 2019

(65) Prior Publication Data

US 2020/0076093 A1 Mar. 5, 2020

Related U.S. Application Data

(60) Provisional application No. 62/724,128, filed on Aug. 29, 2018.

(51) Int. Cl.
*H01R 4/18* (2006.01)

(52) U.S. Cl.
CPC ..... *H01R 4/18* (2013.01)

(58) Field of Classification Search
CPC ..... H01R 4/18
See application file for complete search history.

(56) References Cited

U.S. PATENT DOCUMENTS

| | | | | |
|---|---|---|---|---|
| 2,800,638 | A | 7/1957 | Hammell | |
| 3,831,132 | A * | 8/1974 | Bowden, Jr. | H01R 4/188 439/442 |
| 8,870,611 | B2 * | 10/2014 | Sato | H01R 4/188 439/877 |
| 9,853,368 | B2 * | 12/2017 | Myer | H01R 4/185 |
| 2013/0095708 | A1 * | 4/2013 | Mitose | H01R 43/005 439/878 |
| 2013/0199841 | A1 | 8/2013 | Lehmann | |
| 2014/0106628 | A1 * | 4/2014 | Sato | H01R 4/206 439/877 |
| 2016/0006134 | A1 * | 1/2016 | Ohnuma | H01B 1/023 439/878 |
| 2020/0076093 | A1 * | 3/2020 | Randolph | H01R 4/18 |

OTHER PUBLICATIONS

International Search Report, International Application No. PCT/IB2019/057014, International Filing Date, Aug. 20, 2019.

* cited by examiner

*Primary Examiner* — Abdullah A Riyami
*Assistant Examiner* — Nader J Alhawamdeh

(57) ABSTRACT

An electrical contact assembly having a braided Litz wire and an electrical contact. The electrical contact has a contact portion and a Litz wire termination portion. The contact portion is configured to make an electrical connection with a mating contact. The Litz wire termination portion has serrations which engage the braided Litz wire. The Litz wire termination portion has a length to allow the Litz wire termination portion to make an electrical connection with each individual wire of the Litz wire.

20 Claims, 3 Drawing Sheets

SOLDERLESS CONNECTION TO LITZ WIRE

FIELD OF THE INVENTION

The present invention is directed to an electrical contact which provides a solderless termination to a Litz wire. In particular, the invention is directed to an electrical contact which terminates a braided Litz wire.

BACKGROUND OF THE INVENTION

Litz wire is a unique multistrand wire or cable used in electronics to carry alternating current. The wire is designed to reduce the skin effect and proximity effect losses in conductors used at frequencies up to about 1 MHz, thereby producing a more efficient magnetic field. Litz wire consists of many thin wire strands which are individually insulated.

Litz wire may be twisted or woven together, following one of several carefully prescribed patterns often involving several levels (groups of twisted wires are twisted together, etc.). The result of these winding patterns is to equalize the proportion of the overall length over which each strand is at the outside of the conductor. This has the effect of distributing the current equally among the wire strands, reducing the resistance.

Existing methods of connecting a terminal to deliver power to all strands of Litz wire requires dipping the Litz wire into a solder bath to melt of the insulation from each strand or mechanically strip each strand, prior to termination, in order to assure a connection to each strand. This process consumes time, is potentially hazardous due to outgassing of the insulation material, and is costly. Additionally, existing mechanical crimp connections fail to make contact with each strand in a Litz wire and also tend to break strands due to their inherently aggressive design.

Accordingly, there is a need for an electrical contact which effectively terminates to each strand of a Litz wire without the need to treat or strip the individual wires prior to termination.

SUMMARY OF THE INVENTION

An embodiment is directed to an electrical contact assembly having a braided Litz wire and an electrical contact. The electrical contact has a contact portion and a Litz wire termination portion. The contact portion is configured to make an electrical connection with a mating contact. The Litz wire termination portion has serrations which engage the braided Litz wire. The Litz wire termination portion has a length to allow the Litz wire termination portion to make an electrical connection with each individual wire of the Litz wire.

An embodiment is directed to an electrical contact assembly. The assembly has a braided Litz wire and an electrical contact. The electrical contact has a contact portion and a Litz wire termination portion. The contact portion is configured to make an electrical connection with a mating contact. The Litz wire termination portion has serrations which engage the braided Litz wire. The serrations have a depth of between 0.002 inches and 0.008 inches. The Litz wire termination portion has a length which is at least two times a length of a braided section of the braided Litz wire to allow the Litz wire termination portion to make an electrical connection with each individual wire of the Litz wire.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
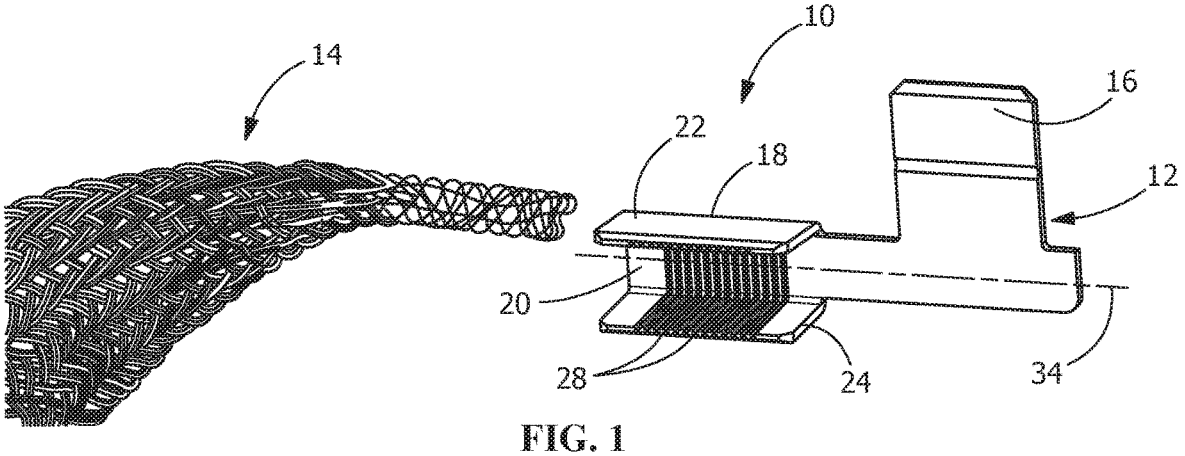
FIG. 1 is a perspective view of an illustrative electrical contact of the present invention and a braided Litz wire prior to termination of the wire in the contact.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

As best shown in FIG. 1, an electrical contact assembly 10 includes an electrical contact 12 and a Litz wire 14. The Litz wire 14 is a multistrand wire or cable used to carry alternating current. The Litz wire reduces the skin effect and proximity effect losses in conductors used at frequencies up to about 1 MHz, thereby producing a more efficient magnetic field. Litz wire consists of many thin wire strands which are individually insulated. The Litz wire 14 used in the electrical contact assembly 10 in braided in a pattern to equalize the proportion of the overall length over which each strand is at the outside of the Litz wire 14. This has the effect of distributing the current equally among the wire strands, reducing the resistance.

The electrical contact 12 has contact portion 16 for mating with a mating connector (not shown) and a Litz wire termination portion 18. In the embodiment shown, the contact portion 16 is a tab. However, other configurations of the contact portion 16, such as a socket or ring portion, may be used. The Litz wire termination portion 18 is configured for crimped connection with an end of a Litz wire 14, as will be more fully described. In the illustrative embodiment shown the electrical contact 12 is stamped and formed from a metal blank or plate having a good electrical conductivity.

The Litz wire termination portion 18 includes a bottom wall 20, a first engaging or crimping arm 22 which extends from one side of the bottom wall 20, and a second engaging or crimping arm 24 which extends from the opposite side of the bottom wall 20 from the crimping arm 22. The bottom wall 20, the first crimping arm 22 and the second crimping arm 24 cooperate with the Litz wire 14 to provide an electrical connection between the Litz wire 14 and the Litz wire termination portion 18 and to maintain the Litz wire in position on the contact 12.

Figure 5:
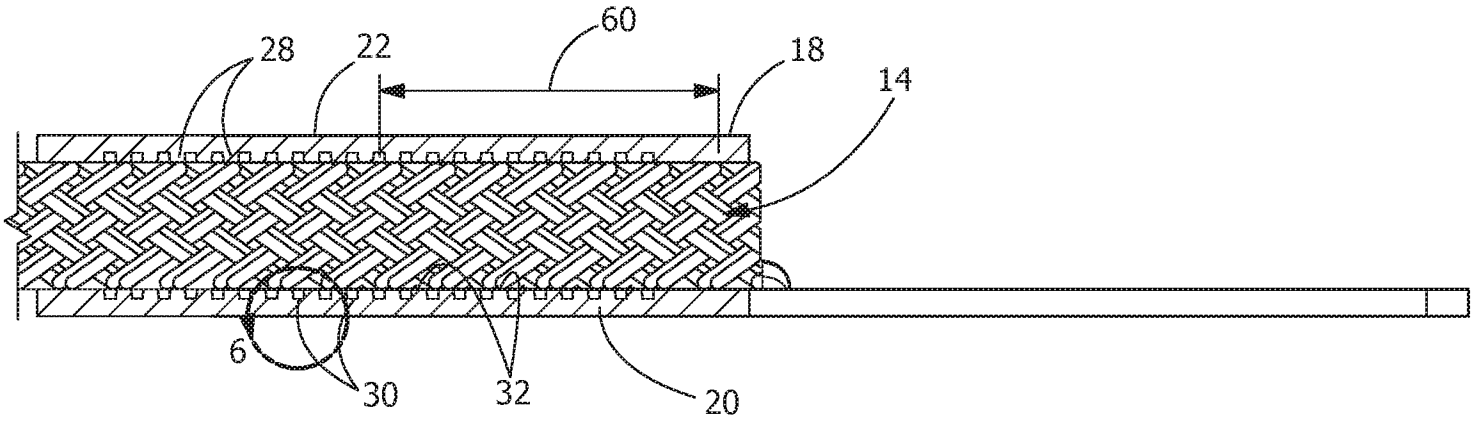
FIG. 5 is a cross-sectional view of the electrical connector of FIG. 2, taken along line 5-5 of FIG. 2.
Figure 6:
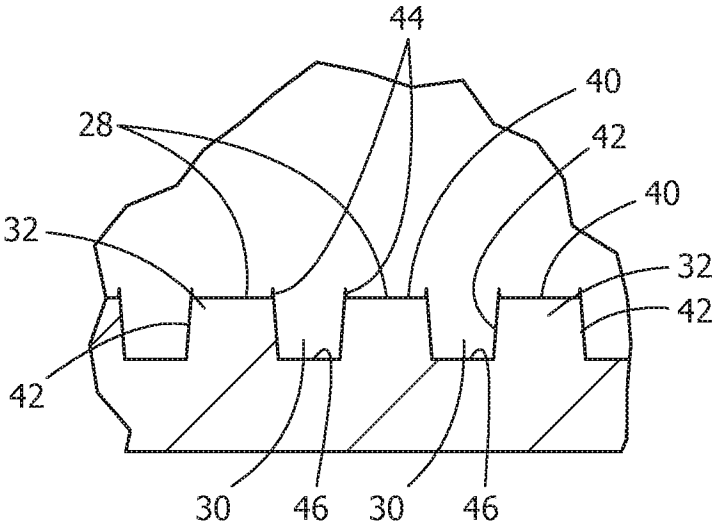
FIG. 6 is an enlarged view of Section A of FIG. 1, showing several recesses and ridges of the serrations.

As best shown in FIGS. 1, 5 and 6, the Litz wire termination portion 18 has a plurality of serrations 28 which include a plurality of recesses or grooves 30 and a plurality of ridges 32 provided proximate the recesses 30. In one exemplary embodiment, the plurality of serrations 28 extend in a direction that is perpendicular to a longitudinal axis 34 of the Litz wire termination portion 18, whereby the plurality of recesses 30 extends in a direction which is transverse to a longitudinal axis 34 of the electrical contact 12. The ridges 32 extend in a direction which is parallel to the plurality of recesses 30, for example in a direction which is transverse to the longitudinal axis 34 of the electrical contact 12. In other embodiments (not shown), the recesses 30 and the ridges 32 extend in a direction which is parallel to the direction of insertion of the Litz wire 14.

As best shown in FIG. 6, each of the ridges 32 of the plurality of serrations 28 has a flat top wall 40 with tapered sidewalls 42 which extend therefrom. The tapered sidewalls 42 also form the sidewalls of the recesses 30. Sharp projections 44 extend from the flat top wall 40. The sharp projections 44 facilitate the engagement between the electrical contact 10 and the Litz wire 12, as the sharp projections 44 will penetrate any coatings or contaminants present on the conductors of the Litz wire 14.

The serrations 28 have a depth, as measured from the flat top walls 40 of the ridges 32 to bottom walls 46 of the recesses 30 of between approximately 0.002 inches and approximately 0.008 inches. The serrations have a centerline to centerline spacing of approximately 0.02 inches along the longitudinal axis 34.

The plurality of serrations 28 interact with the individual conductors of the braided Litz wire 14 to establish mechanical and electrical contact areas between the plurality of ridges 32 of the Litz wire termination portion 18 of the electrical contact 12 and the individual conductors of the braided Litz wire 14. The ridges 32 are configured to penetrate the thin enamel film insulation of the Litz wire 14 and to facilitate the removal of oxides on the Litz wire 14 to establish a positive electrical engagement between the conductive core of the Litz wire and the electrical contact 12.

Although the recesses 30 and ridges 32 shown in the illustrative embodiment extend across the entire breadth of the bottom wall 20, the first crimping arm 22 and the second crimping arm 24, the recesses 30 and ridges 32 may extend over only a portion of the bottom wall 20, the first crimping arm 22 and the second crimping arm 24.

As best shown in the illustrative embodiment of FIG. 5, the Litz wire termination portion 18 has a length which is at least two times a length of a single braided section 46 of the braided Litz wire 14. In another embodiment, the Litz wire termination portion 18 has a length which is at least two times a length of a single braided section 60 of the braided Litz wire 14. However, in other embodiments the length of the Litz wire termination portion 18 may vary, as long as the length of the Litz wire termination portion 18 is sufficient to allow each individual strand of the braided Litz wire 14 to make at least one electrical and mechanical connection to the Litz wire termination portion 18. The Litz wire termination portion 18 is dimensioned to have a length to allow the Litz wire termination portion to make an electrical connection with each individual wire of the Litz wire.

Figure 3:
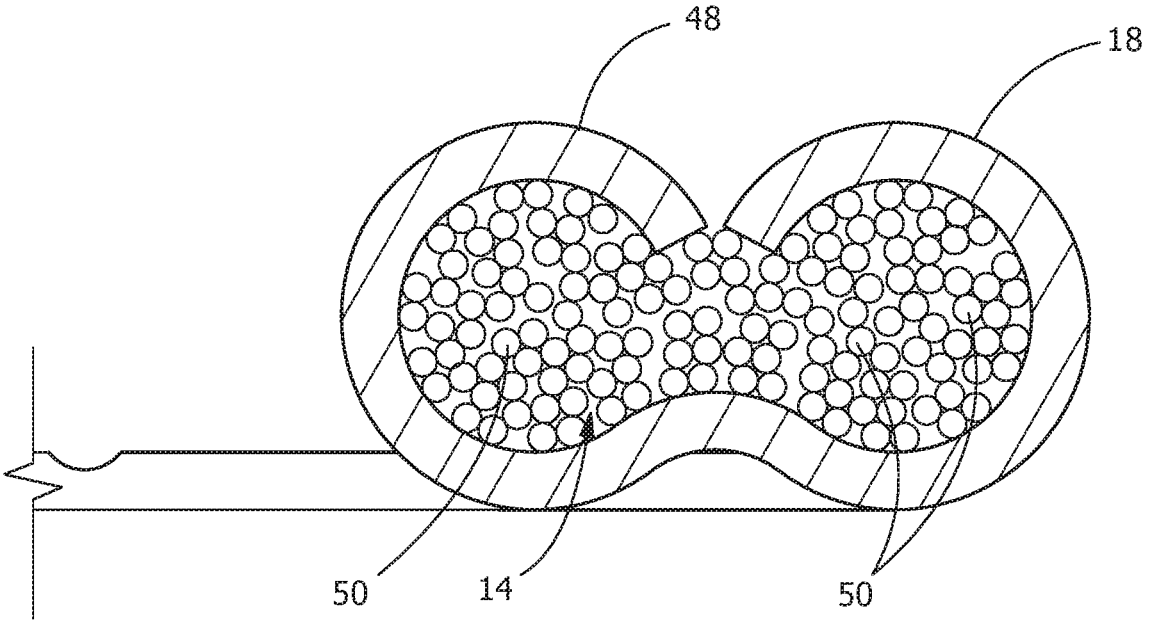
FIG. 3 is a cross-sectional view of the electrical connector of FIG. 2, taken along line 3-3 of FIG. 2.
Figure 4:
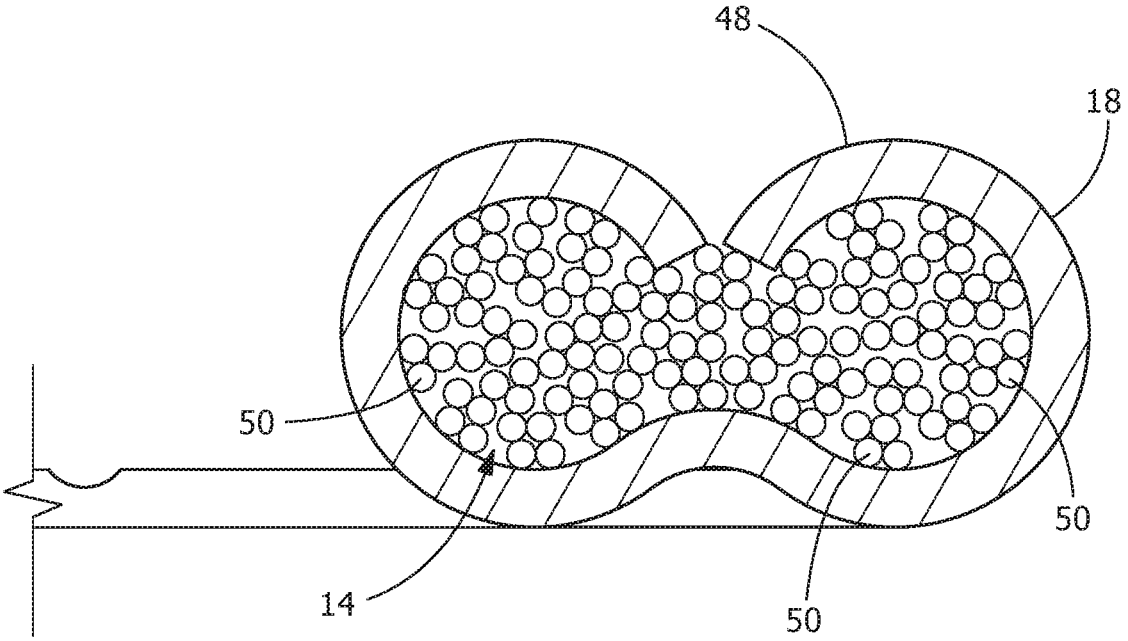
FIG. 4 is a cross-sectional view of the electrical connector of FIG. 2, taken along line 4-4 of FIG. 2.

As an example, due to the braiding of the Litz wire 14, an individual conductor 50 of the braided Litz wire 14 is positioned inside the braided Litz wire 14 in FIG. 3 and on the outside surface of the braided Litz wire 14 in FIG. 4. Consequently, the conductor 50 of the braided Litz wire 14 is not provided in electrical engagement with the Litz wire termination portion 18 in FIG. 3. However, the conductor 50 of the braided Litz wire 14 is provided in electrical engagement with the Litz wire termination portion 18 in FIG. 4.

Figure 2:
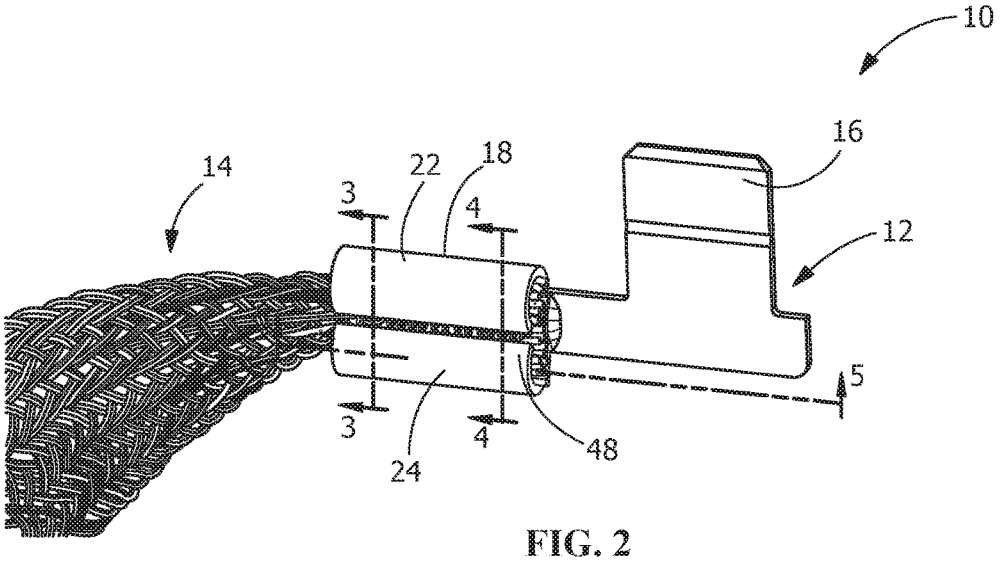
FIG. 2 is a perspective view of an electrical contact assembly of the present invention illustrating the electrical contact of FIG. 1 with the wire terminated therein.

As best shown in FIGS. 2-4, the Litz wire termination portion 18 is crimped onto the braided Litz wire 14. The bottom wall 20 of the Litz wire termination portion 18 is crimped in the shape of a w-crimp. The top wall 48, formed of a portion of the first crimping arm 22 and a portion of the second crimping arm 24, of the Litz wire termination portion 18 is also crimped in the shape of a w-crimp. The w-crimp provides addition surface area in the inside of the Litz wire termination portion 18 to provide additional surface area for the Litz wire termination portion 18 to engage the braided Litz wire 14.

The electrical contact assembly provides one or more effective electrical and mechanical connections between each strand or conductor of a Litz wire and the electrical contact without the need to treat or strip the individual strand or conductors prior to termination.

While the invention has been described with reference to a preferred embodiment, it will be understood by those skilled in the art that various changes may be made, and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials and components, without departing from the spirit or essential characteristics thereof. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. An electrical contact assembly comprising:

a braided Litz wire having multiple wire strands which are individually insulated;

an electrical contact having a contact portion and a Litz wire termination portion, the contact portion is configured to make an electrical connection with a mating contact;

the Litz wire termination portion having serrations which penetrate the individually insulated multiple wire strands of the braided Litz wire, the Litz wire termination portion having a length to allow the Litz wire termination portion to make an electrical and mechanical connection with each individual wire strand of the multiple wire strands of the Litz wire.

2. The electrical contact assembly as recited in claim 1, wherein the serrations of the Litz wire termination portion extend in a direction with is perpendicular to a longitudinal axis of the Litz wire termination portion.

3. The electrical contact assembly as recited in claim 1, wherein each serration has a top wall with tapered sidewalls which extend therefrom.

4. The electrical contact assembly as recited in claim 1, wherein each serration has a top wall with a flat surface.

5. The electrical contact assembly as recited in claim 1, wherein the serrations have a depth of between 0.002 inches and 0.008 inches.

6. The electrical contact assembly as recited in claim 1, wherein the serrations have a centerline to centerline spacing of 0.02 inches.

7. The electrical contact assembly as recited in claim 1, wherein the Litz wire termination portion has a length which is at least two times a length of a braided section of the braided Litz wire.

8. The electrical contact assembly as recited in claim 1, wherein the contact portion is a tab.

9. The electrical contact assembly as recited in claim 1, wherein the Litz wire termination portion is crimped to the Litz wire.

10. The electrical contact assembly as recited in claim 9, wherein the Litz wire termination portion has a bottom wall crimped in the shape of a w-crimp.

11. The electrical contact assembly as recited in claim 10, wherein the Litz wire termination portion has a top wall crimped in the shape of an inverted w-crimp.

12. An electrical contact assembly comprising:

a braided Litz wire having multiple wire strands which are individually insulated;

an electrical contact having a contact portion and a Litz wire termination portion, the contact portion is configured to make an electrical connection with a mating contact;

the Litz wire termination portion having serrations which engage the individually insulated multiple wire strands of the braided Litz wire, the Litz wire termination portion having a length which is at least two times a length of a braided section of the braided Litz wire to allow the Litz wire termination portion to make an electrical and mechanical connection with each individual wire strand of the multiple wire strands of the Litz wire.

13. The electrical contact assembly as recited in claim 12, wherein the serrations of the Litz wire termination portion extend in a direction with is perpendicular to a longitudinal axis of the Litz wire termination portion.

14. The electrical contact assembly as recited in claim 13, wherein the Litz wire termination portion is crimped to the Litz wire.

15. The electrical contact assembly as recited in claim 14, wherein the Litz wire termination portion has a bottom wall crimped in the shape of a w-crimp.

16. The electrical contact assembly as recited in claim 15, wherein the Litz wire termination portion has a top wall crimped in the shape of an inverted w-crimp.

17. The electrical contact assembly as recited in claim 12, wherein the contact portion is a tab.

18. The electrical contact assembly as recited in claim 12, wherein each serration has a top wall with tapered sidewalls which extend therefrom.

19. The electrical contact assembly as recited in claim 18, wherein the top wall has a flat surface.

20. The electrical contact assembly as recited in claim 19, wherein the serrations have a centerline to centerline spacing of 0.02 inches.

* * * * *